US006738733B1

(12) United States Patent
Tian

(10) Patent No.: US 6,738,733 B1
(45) Date of Patent: May 18, 2004

(54) G.723.1 AUDIO ENCODER

(75) Inventor: Wenshun Tian, Singapore (SG)

(73) Assignee: STMicroelectronics Asia Pacific Pte Ltd., Singapore (SG)

( * ) Notice: Subject to any disclaimer, the term of this patent is extended or adjusted under 35 U.S.C. 154(b) by 0 days.

(21) Appl. No.: 10/089,758

(22) PCT Filed: Sep. 30, 1999

(86) PCT No.: PCT/SG99/00096

§ 371 (c)(1),
(2), (4) Date: Jul. 22, 2002

(87) PCT Pub. No.: WO01/24166

PCT Pub. Date: Apr. 5, 2001

(51) Int. Cl.[7] ..... G01L 5/00
(52) U.S. Cl. ..... 702/189; 704/219
(58) Field of Search ..... 702/189, 38, 46, 702/54, 57, 66, 72, 79, 122, 179, 181, 182, 190, 193; 704/201, 216, 219, 250, 263

(56) References Cited

U.S. PATENT DOCUMENTS

| | | | | |
|---|---|---|---|---|
| 5,602,961 A | * | 2/1997 | Kolesnik et al. | 704/223 |
| 5,664,055 A | * | 9/1997 | Kroon | 704/223 |
| 5,701,392 A | * | 12/1997 | Adoul et al. | 704/219 |
| 5,717,825 A | | 2/1998 | Lamblin | 395/2.32 |
| 5,787,391 A | * | 7/1998 | Moriya et al. | 704/225 |
| 5,854,998 A | | 12/1998 | Flomen et al. | 704/223 |
| 6,073,092 A | * | 6/2000 | Kwon | 704/219 |

FOREIGN PATENT DOCUMENTS

| | | |
|---|---|---|
| EP | 0 865 027 A2 | 9/1998 |
| JP | 11-119799 | 4/1999 |

OTHER PUBLICATIONS

Lee, S. et al., "Cost Effective Implementation of ITU–T G.723.1 on a DSP Chip," in *Proceedings of the IEEE Int'l Symposium on Consumer Electronics*, Singapore, Dec. 2–4, 1997, pp. 31–34.

Fujita, G. et al., "Implementation of H.324 Audiovisual Codec for Mobile Computing," in *Proceedings of the IEEE Custom Integrated Circuits Conference*, Santa Clara, CA, May 11–14, 1998, pp. 193–196.

Cui, H. et al., "Audio as a Support to Low Bitrate Multimedia Communication," in *Proceedings of the IEEE International Conference on Communications Technology*, Beijing, China, Oct. 22–24, 1998, pp. 544–547.

* cited by examiner

*Primary Examiner*—Marc S. Hoff
*Assistant Examiner*—Edward Raymond
(74) *Attorney, Agent, or Firm*—Lisa K. Jorgenson; E. Russell Tarleton; Seed IP Law Group PLLC

(57) ABSTRACT

A method and apparatus for reducing the computational load of a dual-rate encoding system having a multi-pulse maximum likelihood quantization process configured to transmit at a first transmission rate and to search subframes of excitation signals according to a reduced number of gain scale factors; and an algebraic code-excited linear prediction block configured to perform a first correlation threshold test for entry into an embedded signal processing loop and a second correlation threshold test for entry into a previous signal processing loop in which the embedded signal processing loop is embedded to reduce the number of times the previous signal processing loop and the embedded signal processing loop are entered, thereby reducing the computational load of the system.

23 Claims, 1 Drawing Sheet

G.723.1 AUDIO ENCODER

Figure 1:
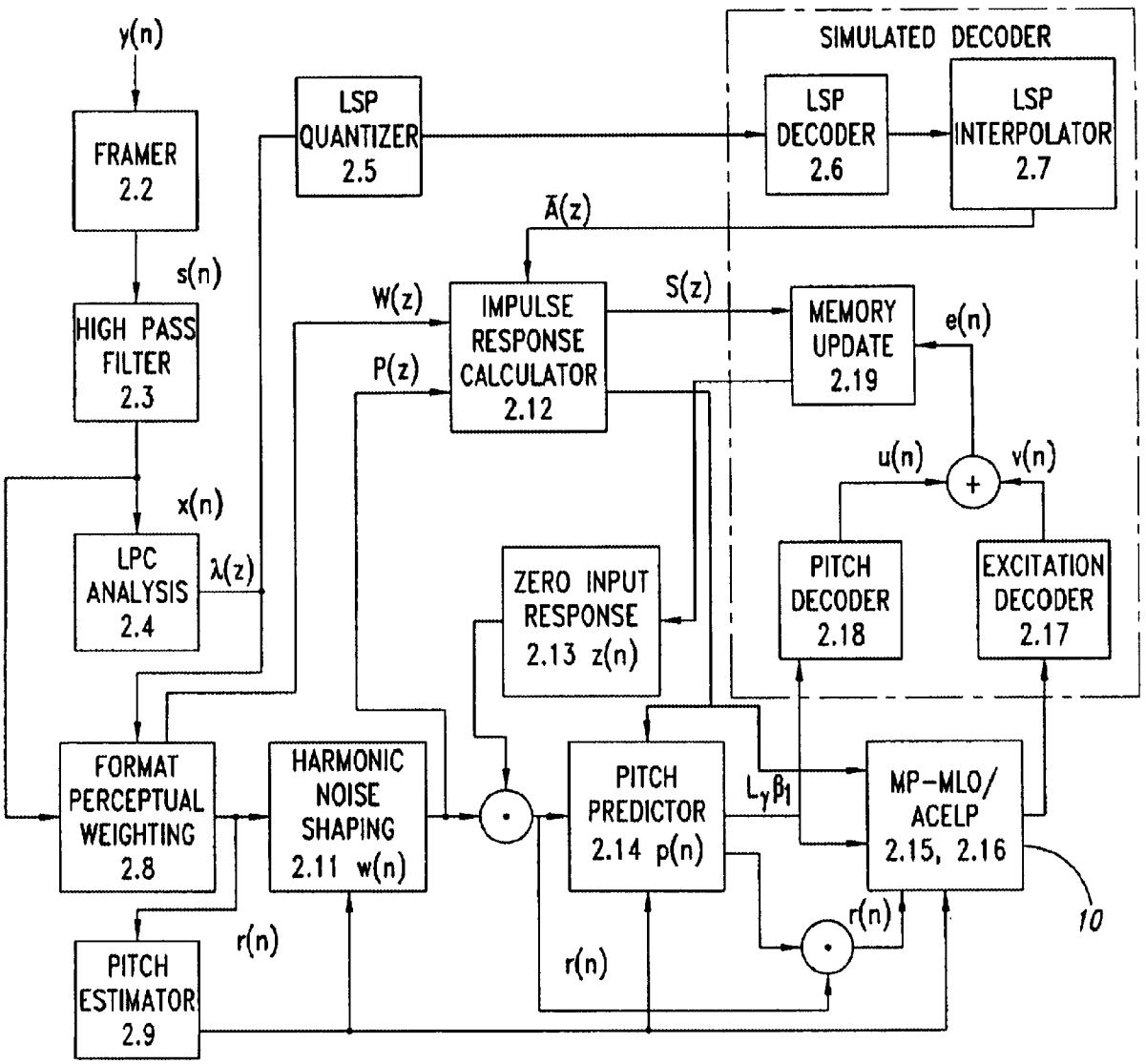

The present invention relates to low complexity encoders, and more particularly, to low complexity encoders for implementing recommendation G.723.1 of the International Telecommunication Union (ITU-T).

BACKGROUND OF THE INVENTION

1. Field of the Invention

Lower complexity compressors/decompressors (codecs) may be preferred for some computationally intensive applications. If the complexity of the codec is the bottleneck in a system, complexity reduction is desirable and can result in a significant reduction in millions of instructions per second (MIPS) required to be executed by the encoder.

2. Description of the Related Art

SUMMARY OF THE INVENTION

The ITU-T recommendation G.723.1, incorporated herein by reference, relates to dual rate speech coding for multimedia communications transmitting at 5.3 and 6.3 Kbps. The recommendation prescribes certain methods of implementation for each of these transmission rates. The 6.3 Kbps codec has better quality and uses Multi-Phase Maximum Likelihood Quantization (MP-MLQ) for fixed codebook excitation. The 5.3 Kbps codec uses Algebraic Code-Excited Linear Prediction (ACELP). A functional module of the codec which executes these two encoding methods bears almost half of the computational load of the entire G.723.1speech coder. If the methods executed by the functional module are made to have a decreased computational load, the G.723.1 speech coder will have an increased efficiency.

The present invention provides a method of reducing the computational load of a dual rate encoding system, the encoding system being configured to transmit at a first transmission rate using a Multi-Pulse Maximum Likelihood Quantization (MP-MLQ) process or at a second transmission rate using an Algebraic Code-Excited Linear Prediction (ACELP) process, wherein the MP-MLQ process normally searches subframes of excitation signals according to a nominal number of gain scale factors in the execution of quantization steps for encoding the speech signals and the ACELP process normally imposes a first correlation threshold test for entry into an embedded signal processing loop, the method including the step of:

for the MP-MLQ process, reducing the number of gain scale factors employed in the quantization steps, thereby reducing the number of searches, which in turn reduces the computational load; and for the ACELP process, imposing a second correlation threshold test for entry into a previous signal processing loop in which the embedded signal processing loop is embedded, thereby reducing the number of times the previous signal processing loop and the embedded signal processing loop are entered, which in turn reduces the computational load.

The present invention further provides a dual rate speech coding system having a reduced computational load, the encoding system having Multi-Pulse Maximum Likelihood Quantization (MP-MLQ) processing means for But ting at a first transmission rate and Algebraic Codec-Excited Linear Prediction (ACELP) processing means for transmitting at a second transmission rate, wherein the MP-MLQ processing means normally searches subframes of excitation signals according to a nominal number of gain scale factors in quantization of the speech signals, and the ACELP processing means normally uses a first correlation threshold test for allowing entry into an embedded signal processing loop, wherein:

the MP-MLQ processing means has a reduced number of gain scale actors for reducing the number of searches and thereby reducing the computational load;

the ACELP processing means uses a second correlation threshold test for allowing entry into a previous signal processing loop in which the embedded signal processing loop is embedded, thereby reducing the number of times the previous signal processing loop and the embedded signal processing loop are entered, which in turn reduces the computational load.

Advantageously, embodiments of the invention simplify the ACELP and MP-MLQ methods by reducing the number of recursions, which make less contribution to the metrics. This is achieved by selecting less gain levels or putting an extra threshold to decrease the chance to enter the most computational intensive loops.

Advantageously, the proposed encoder scheme is applicable for both ITU-T recommendations G.723.1 and G.723.1A. For ACELP excitation, further complexity reduction is possible by adjusting the thresholds. This complexity reduction for ACELP excitation is also applicable for G.729 and its annexes.

BRIEF DESCRIPTION OF THE SEVERAL VIEWS OF THE DRAWING(S)

The present invention will now be described in further detail, by way of example only, with reference to the accompanying drawing.

DETAILED DESCRIPTION OF THE INVENTION

FIG. 1 is a block diagram of the G.723.1 speech coder.

Reference is also made to the following procedures which are appended to this description. Procedure 1 is a pseudocode representation of the standard MP-MLQ procedure of the G.723.1 speech coder; Procedure 2 is a pseudocode representation of the MP-MLQ procedure of an embodiment of the present invention; Procedure 3 is a pseudocode representation of the standard ACELP procedure of the G.723.1 speech coder; Procedure 4 is a pseudocode representation of the ACELP procedure of an embodiment of the present invention.

A MP-MLQ/ACELP block 10 for implementing the MP-MLQ and ACELP excitation methods is shown in FIG. 1. These methods take up almost half of the computational load of the whole codec. Since embodiments of the present invention only relate to these two fixed codebook excitation methods, the description relates only to these excitation techniques and not to other parts of the G.723.1 speech coder. Apart from the fixed codebook excitation part (i.e. block 10), all other modules are the same for the dual rate coders. The decoding scheme, for decoding bit streams encoded with the low complexity encoder, remains the same as for the normal ITU-T G.723.1 recommendation.

MP-MLQ Excitation (Normal Complexity)

The object of the quantization procedure is to find the optimized excitation $e_u(n)$ that makes the mean square error minimum, based on an analysis by the synthesis method. The excitation signal is given by $$e_u(n) = G_u \sum_{k=0}^{N_p-1} \alpha_k \delta(n-\xi_k), \quad 0 \le n \le 59 \tag{1}$$

where $G_u$ is the gain factor, $\delta(n)$ is a Dirac function, $\{\alpha_k\}_{k=0 \cdots Np-1}$ and $\xi_k$ are the signs (±1) and positions of the Dirac functions respectively, and $N_p$ is the number of pulses, which is 5 for odd subframes and 6 for even subframes. The pulse positions are either all odd or all even. This is indicated by a grid bit.

The scalar gain quantizer consists of 24 steps, of 3.2 dB in each step. Around the quantized value, $G_u$, additional gain values are selected within the range [$G_u$−6.4 dB; $G_u$+3.2 dB]. The optimal combination of pulse locations and gains are then transmitted to the remaining encoder modules.

To improve the quality of speech with a short pitch period, the following additional procedure is used. If the pitch lag is less than 58 samples for a particular subframe, a train of Dirac functions with a period of the pitch index is used for each location k instead of a single Dirac function in the above quantization procedure. The choice between a train of Dirac functions or a single Dirac function to represent the residual signal is made based on the mean square error computation. The configuration which yields the lowest mean square error is selected.

Based on the above brief description of MP-MLQ, the optimization procedure is represented in pseudocode as shown in Procedure 1. The symbols InsCI inside the brackets are the cycles needed for a given processor; and the number of cycles if using, for example, a D950 processor. The D950 is a normal 16-bit fixed-point digital signal processor (DSP) made by STMicroelectronics. Other 16-bit fixed-point DSPs are the ADSP-2181 by Analog Devices and the TMS320C54x series by Texas Instruments. Although the number of instructions required to execute the same function may vary among different DSPs, the invention will still achieve a significant savings in MIPS for each appropriate DSP.

The worst case for MP-MLQ is that the above optimization procedure is conducted twice when the pitch is less than 58 samples. The total number of cycles per subframe is given by:

$$\text{Total cycles per subframe}=2\times\{\text{Ins}C1+2\times[\text{Ins}C2+\text{Ins}C6+4\times(\text{Ins}C3+\text{Ins}C4+\text{Ins}C5)]\} \quad (2)$$

Therefore the total number of cycles per subframe for Procedure 1 is 64368 if using the D950 processor.

ACELP Excitation (Normal Complexity)

For the ACELP technique for fixed codebook excitation, a 17-bit algebraic codebook is used for the stochastic codebook excitation $e_{ua}(n)$. Each fixed codevector contains four non-zero pulses that can assume the signs and positions given in the following table.

TABLE 1

| ACELP excitation codebook | | | | | | | | |
|---|---|---|---|---|---|---|---|---|
| Sign | Positions | | | | | | | |
| ±1 | 0 | 8 | 16 | 24 | 32 | 40 | 48 | 56 |
| ±1 | 2 | 10 | 18 | 26 | 34 | 42 | 50 | 58 |
| ±1 | 4 | 12 | 20 | 28 | 36 | 44 | 52 | (60) |
| ±1 | 6 | 14 | 22 | 30 | 38 | 46 | 54 | (62) |

In the table, all pulses are in the even positions but the positions of all pulses can be simultaneously shifted by one (to occupy odd positions) when requiring one extra bit. Note that the last position of each of the last two pulses falls outside the subframe boundary, which signifies that the pulse is not present. Each pulse position is encoded with 3 bits and each pulse sign is encoded with 1 bit. This gives a total of 16 bits for the 4 pulses. Further, an extra bit is used to encode the shift. The excitation sequence is defined as:

$$e_{ua,m}(n)=\alpha_0\delta(n-\xi_\alpha)+\alpha_1\delta(n-\xi_1)+\alpha_2\delta(n-\xi_2)+\alpha_3\delta(n-\xi_3) \quad (3)$$

where $\xi_k$ is the position of the $k^{th}$ pulse and $\alpha_k$ is its sign (±1).

A focused search approach is used to simplify the search procedure. To limit the number of times entering the last loop, a threshold is applied and the last loop is entered only if this threshold is exceeded. The maximum number of times the loop can be entered is fixed so that a low percentage of the codebook is searched. The maximum absolute correlation $C_{max3}$ and the average correlation $C_{av3}$ due to the contribution of the first three pulses are found prior to the codebook search. The threshold is given by:

$$\text{thr3}=C_{av3}+(C_{max3}-C_{av3})/2 \quad (4)$$

The fourth loop is entered only if the absolute correlation (of the three pulses) exceeds thr3. To further control the search, the number of times the last loop is entered (for the 4 subframes) is not allowed to exceed 600. (The average worst case per subframe is 150 times).

Based on the above brief description of ACFLP, the optimization procedure is represented in pseadocode as shown in Procedure 3. In Procedure 3, InsCi is the number of instruction cycles, followed by an example number of cycles for the D950 implementation. The total cycles are calculated by:

$$\begin{aligned}&\text{Ins}C1+\text{Ins}C12+8\times(\text{Ins}C2\\&+\text{Ins}C11)+8^2\times(\text{Ins}C3\\&+\text{Ins}C10)+8^3\times(\text{Ins}C4\\&+\text{Ins}C9)+\text{time}_3\times(\text{Ins}C5\\&+\text{Ins}C7+8\times\text{Ins}C6)+(8^3\\&-\text{time}_3)\times\text{Ins}C8=27207\\&+\text{timer}_3\times238\ [\text{if using a D950 processor}]\\&=62907\ [\text{if time}_3=150]\end{aligned} \quad (5)$$

where $\text{time}_3$ is the number of times entering the last loop. At the worst case, the maximum number of $\text{time}_3$ is set to 150. Therefore the worst case cycles per 7.5 ms subframe are 62907 if using a D950 processor, which equates to 8.4 MIPS.

Lower Complexity Implementations

In embodiments of the invention the modules (codes) may be shared by both G.723.1 and the lower complexity implementation of the G.723.1 coder (LC-G.723.1). Preferably, the coding system is selectable between bit-exact G.723.1 and LC-G.723.1 coders, leading to an embedded system. This is shown by the procedure as follows:

```
If (lower complexity enabled)
  If (6.3 kbit/s)
    6.3 kbit/s LC-G723.1 encoding
  Else 5.3 kbit/s LC-G723.1 encoding
Else
  If (6.3 kbit/s)
    6.3 Kbit/s encoding
  Else 5.3 Kbit/s encoding
```

For the low-complexity encoding of 6.3 Kbps and 5.3 Kbps codecs in accordance with the present invention, the operation procedures are shown in Procedure 2 and Procedure 4 respectively.

One of the characteristics of MP-MLQ is that the latter pulse contribution will be added upon the previous one and all pulses are scaled by one gain. For each new found pulse, the gain is further fine tuned within the range [−6.4 dB;−3.2 dB; 0; +3.2 dB]. Since all pulses share one gain, the observation is that the gain level decreases as the number of found pulses increases. Due to the characteristic of MP-MLQ, the additional higher gain levels (0 and +3.2 dB) are rarely selected. In this simplification, we only use two gain levels, i.e. −4 dB and −3.2 dB around the previous quantized gain. Therefore the number of instructions inside the gain searching loop can be decreased by about half for catch subframe when the pitch lag is less than 58 samples.

The worst case number of cycles for MP-MLQ is calculated as:

$$\text{Total cycles per subframe}=2\times\{\text{Ins}C1+2\times[\text{Ins}C2+\text{Ins}C6+2\times(\text{Ins}C3+\text{Ins}C4+\text{Ins}C5)]\} \quad (6)$$

For the D950 example, the total number of cycles per subframe is 39424.

For an adaptive codebook search, the worst case is when the pitch lag ≧58, which is just the opposite of fixed codebook excitation. If the number of gain levels decreases from 4 to 2 for fixed codebook excitation, the computational load is reduced from Equation (2) to Equation (6). To balance the computational load for all cases, the codes are also simplified for when the pitch lag ≧58. The number of searched gain levels is reduced from 4 to 3, i.e. −6.4, −3.2 and 0 dB. (please refer to Procedure 2).

The number of cycles per subframe for MP-MLQ with a pitch lag ≧58 is calculated as:

$$\text{Total cycles per subframe}=\text{Ins}C1+2\times[\text{Ins}C2+\text{Ins}C6+3\times(\text{Ins}C3+\text{Ins}C4+\text{Ins}C5)] \quad (7)$$

The total number of cycles per subframe would then be 19826 for the D950 processor example.

Comparing Equations (2) and (6), 24944 cycles per subframe can be saved at worst case (of MP-MLQ) if using the D950 processor. This equates to a saving of 3.3 MIPS. For the normal case, in which MP-MLQ is conducted once, the saved cycles are 12358 per subframe, which equates to 1.65 MIPS. This unbalanced complexity reduction in the fixed codebook search (MP-MLQ) corresponds to the unbalanced computational load adaptive codebook search, in which, for example, about 30,000 and 46,000 cycles are needed respectively for the worst case and normal case of MP-MLQ.

An advantage of the embodiments of the invention is a reduction in the complexity for the worst case scenario (i.e., under the most intensive computational load). If the complexity is reduced in the worst case, the overall MIPS requirement is reduced accordingly. At the higher bit rate, the most complex modules are the fixed codebook excitation module (MP-MLQ) and adaptive excitation module. The complexity of these two modules changes depending on the pitch lag, while other modules are relatively stable in terms of computational load. Shown in Table 2 below is a comparison of the MIPS requirements for the worst case (pitch lag <58 samples) and the normal case (pitch lag ≧58) for a D950 DSP.

From Procedure 3 and Equation (5), it is apparent that any instructions inside the $i_2$ and $i_3$ loops will be executed hundreds of times. It may be advantageous to further limit the numbers entering these two loops. Instead of using one threshold, two thresholds are used. Both the maxium absolute correlation and the average correlation due to the contribution of the first two and three pulses, $C_{max2}$ and $C_{av2}$, and $C_{max3}$ and $C_{av3}$, are found prior to the codebook search. The thresholds are calculated by:

$$\text{thr2}=(C_{av2}+(C_{max2}-C_{av2})/4) \quad (8)$$

$$\text{thr3}=(C_{av3}+(C_{max3}-C_{av3})/3) \quad (9)$$

Now there are two thresholds. To further control the search, the average number of times the third and last loops are entered is not allowed to exceed 32 and 75 (for example), respectively for each subframe. The proposed low-complexity ACELP optimization procedure is modified as in Procedure 4.

The total number of cycles per subframe is given by:

$$\begin{aligned}&\text{Ins}c1+\text{Ins}C12+8\times(\text{Ins}C2\\&+\text{Ins}C11)+64\times(\text{Ins}C3\\&+\text{Ins}C10)+\text{time}_2\times(\text{Ins}C13\\&+\text{Ins}C14)+(64-\text{time}_2)\times\text{Ins}C15\\&+\text{time}_2\times8\times(\text{Ins}C4\\&+\text{Ins}C9)+\text{time}_3\times8\\&\times(\text{Ins}C7+8\times\text{Ins}C6)+(\text{time}_2\times8\\&-\text{time}_3)\times\text{Ins}C8=8373\\&+\text{time}_2\times336+\text{time}_3\times238\end{aligned} \quad (10)$$

where $\text{time}_2$ and $\text{time}_3$ are the number of times the processor enters into the $3^{rd}$ and $4^{th}$ loops respectively. For the worst case, the $\text{time}_2$ and $\text{time}_3$ are set to 32 and 75 respectively. Therefore the worst case number of cycles will become 36976. Comparing with Equation (5), 25932 cycles or 3.45 MIPS can be saved (if using the D950 processor).

It should be noted that further complexity reduction is simple to effect for this ACELP excitation by choosing smaller $\text{time}_2$ and $\text{time}_3$ parameters and corresponding higher thresholds. The proposed parameters for this LC-G.723.1 are based on the objective that LC-G.723.1 should have similar performances to G.723.1. If further reduction of complexity is needed, the performance will be smoothly degraded. For example, by increasing the threshold levels and corresponding allowed loop entry times $\text{time}_2$ and $\text{time}_3$ to and 60 respectively, a further 1.01 MIPS can be saved.

From the foregoing it will be appreciated that, although specific embodiments of the invention have been described

TABLE 2

Complexity comparison 6.3 kbits/s for one subframe (7.5 ms)

| 6.3 kbits | | Pitch lag ≧ 58 | | | Pitch lag ≧ 58 (Worst case) | | |
|---|---|---|---|---|---|---|---|
| | | Adaptive | ML-LPQ | Sum | Adaptive | ML-LPQ | Sum |
| Normal | Cycles | 46000 | 32184 | 78184 | 30000 | 64368 | 94368 |
| G.723.1 | MIPS | 6.13 | 4.29 | 10.42 | 4.0 | 8.58 | 12.58 |
| LC | Cycles | 46000 | 19826 | 65826 | 30000 | 39424 | 69424 |
| G.723.1 | MIPS | 6.13 | 2.64 | 8.77 | 4.0 | 5.26 | 9.26 |

herein for purposes of illustration, various modifications may be made without deviating from the spirit and scope of the invention. Accordingly, the invention is not limited except as by the appended claims.

PROCEDURE 1

```
do twice or once depending on the pitch lag
    pre-search (InsC1, 6116)
    for k = 0,1 (grid)
        find the first pulse and quantize gain (InsC2, 537)
            for i = 1, 2, 3, 4 (gain)
                prepare searching (InsC3, 173)
                find remain pulses (InsC4, 2261)
                evaluate the error (InsC5, 687)
            post process (InsC6, 13)
```

PROCEDURE 2

```
if pitch lag <58 do twice
pre-search (InsC1, 6116)
    for k = 0,1 (grid)
        find the first pulse and quantize gain (InsC2, 2537)
            for i = 1, 2 (gain)
                prepare searching (InsC3, 173)
                find remain pulses (InsC4, 2261)
                evaluate the error (InsC5, 687)
            post process (InsC6, 13)
else do once
pre-search (InsC1, 6116)
    for k = 0,1 (grid)
        find the first pulse and quantize gain (InsC2, 2537)
            for i = 1, 2, 3 (gain)
            prepare searching (InsC3, 173)
            find remain pulses (InsC4, 2261)
            evaluate the error (InsC5, 687)
            post process (InsC6, 13)
```

PROCEDURE 3

```
pre-search (InsC1,4195)
for i0 = 0, . . .,7 (first pulse)
    partial correlation & energy calculation (InsC2, 12)
    for i1 = 0, . . .,7 (second)
        partial correlation & energy calculation (InsC3, 26)
        for i2 = 0, . . .,7 (third)
            partial correlation & energy calculation
            (InsC4, 30)
            if (correlation > threshold)
                prepare for last loop (InsC5, 14)
                for i3 = 0, . . .,7 (last)
                    {correlation & energy
                    calculation and evaluation
                    (InsC6, 25)}
                update (InsC7,26)
            else
            Update (InsC8, 2)
            post process (InsC9, 5)
        post process (InsC10, 22)
    do post (InsC11, 17)
post process (InsC12, 746)
```

PROCEDURE 4

```
pre-search (InsC1, 4915)
for i0 = 0, . . .,7 (first loop)
    partial correlation & energy calculation (InsC2, 12)
```

-continued

PROCEDURE 4

```
    for il = 0, . . .,7 (second)
        partial correlation & energy calculation (InsC3, 26)
        if (correlation > threshold2)
            preparation (Ins13, 14)
            for i2 = 0, . . .,7 (third)
                partial correlation & energy calculation
                (InsC4, 30)
                if (correlation > threshold)
                    preparation (InsC5, 14)
                    for i3 = 0, . . ., 7 (last)
                    {correlation & energy calculation,
                    and evaluation (InsC6,25)}
                    post process
                else
                update (InsC8, 2)
            do post process (InsC9, 5)
        post process (InsC14, 26)
    else
        update (InsC15, 2)
    post process (InsC10, 22)
  post process (InsC11, 17)
post process (InsC12, 746)
```

What is claimed is:

1. A method of reducing the computational load of a dual rate encoding system, the encoding system configured to transmit at a first transmission rate using a Multi-Pulse Maximum Likelihood Quantization (MP-MLQ) process and at a second transmission rate using an Algebraic Code-Excited Linear Prediction (ACELP) process, wherein the MP-MLQ process normally searches subframes of excitation signals according to a nominal number of gain scale factors in the execution of quantization steps for encoding the speech signals, and the ACELP process normally imposes a first correlation threshold test for entry into an embedded signal processing loop, the method comprising:

for the MP-MLQ process, reducing the number of gain scale factors employed in the quantization steps, thereby reducing the number of searches, which in turn reduces the computational load; and for the ACELP process, imposing a second correlation threshold test for entry into a previous signal processing loop in which the embedded signal processing loop is embedded, thereby reducing the number of times the previous signal processing loop and the embedded signal processing loop are entered, which in turn reduces the computation load.

2. The method of claim 1, wherein the second threshold test is applicable for entry into a third of four signal processing loops.

3. The method of claim 2, wherein when the second transmission rate is applicable, the method further includes the step of substituting for the first threshold a higher threshold for entry into a fourth signal processing loop.

4. The method of claim 3, wherein when the second transmission rate is applicable, further including the step of limiting the number of times the third and fourth signal processing loops may be entered.

5. The method of claim 4, wherein the third and fourth signal processing loops may be entered up to 32 or 75 times respectively for each of the speech subframes.

6. The method of claim 5, wherein the dual rate coding system is in accordance with the ITU-T G.723.1 recommendation.

7. The method of claim 1, wherein when a pitch lag of the subframe is less than a predetermined parameter, the number of gain scale factors searched is reduced from four to two.

8. The method of claim 7, wherein when the pitch lag of the subframe is equal to or greater than the predetermined parameter, the number of gain scale factors searched is reduced from four to three.

9. The method of claim 8, wherein the predetermined parameter is 58.

10. The method of claim 1, wherein the quantization steps and a pre-search are executed once when the pitch lag is greater than or equal to 58 and twice when the pitch lag is less than 58.

11. A dual rate speech coding system having a reduced computational load, the encoding system comprising a Multi-Pulse Maximum Likelihood Quantization (MP-MLQ) processing means for transmitting at a first transmission rate and an Algebraic Code-Excited Linear Prediction (ACELP) processing means for transmitting at a second transmission rate, the MP-MLQ processing means configured to search subframes of excitation signals according to a nominal number of gain scale factors in quantization of the speech signals, and the ACELP processing means configured to use a first correlation threshold test for allowing entry into an embedded signal processing loop, and wherein:

the MP-MLQ processing means has a reduced number of gain scale factors for reducing the number of searches and thereby reducing the computation load; and the ACELP processing means uses a second correlation threshold test for allowing entry into a previous signal processing loop in which the embedded signal processing loop is embedded, thereby reducing the number of times the previous signal processing loop and the embedded signal processing loop are entered, which in turn reduces the computational load.

12. The coding system of claim 11, wherein the second correlation threshold test is used to allow entry into a third of four signal processing loops.

13. The coding system of claim 12, wherein when the second transmission rate is applicable, the coding system has a higher threshold, use in place of the first threshold, for entry into the fourth signal processing loop.

14. The coding system of claim 13, wherein when the second transmission rate is applicable, the number of times the third and fourth signal processing loop may be entered is limited.

15. The coding system of claim 14, wherein the limit for entry into the third and fourth signal processing loops is 32 or 75 times, respectively, for each of a plurality of speech subframes.

16. The coding system of claim 11, wherein the dual rate coding system is in accordance with the ITU-T G.723.1 recommendation.

17. The coding system of claim 11, wherein when a pitch lag of the subframe is less than a predetermined parameter, the number of gain scale factors searched is reduced from four to two.

18. The coding system of claim 17, wherein when a pitch lag of the subframe is equal to or greater than the predetermined parameter, the number of gain scale factors searched is reduced from four to three.

19. The coding system of claim 18, wherein the predetermined parameter is 58.

20. The coding system of claim 11, wherein the quantization steps and a pre-search are executed once when the pitch lag is greater than or equal to 58 and twice when the pitch lag is less than 58.

21. A dual rate encoding system, comprising:

a multi-pulse maximum likelihood quantization (MP-MLQ) unit configured to search sub frames of excitation signals with a reduced number of gain scale factors in quantization of speech signals; and an algebraic code-excited linear prediction (ACELP) unit configured to perform a first correlation threshold test and a second correlation threshold test for allowing entry into an embedded signal processing loop wherein the second correlation threshold test is used to allow entry into a previous signal processing loop in which the embedded signal processing loop is embedded to reduce the number of times the previous signal processing loop and the embedded signal processing loop are entered.

22. A dual rate speech encoding system for multimedia communications, comprising:

a multi-phase maximum likelihood quantization (MP-MLQ) block for fixed code book excitation at 6.3 Kbps, the MP-MLQ block configured to search sub frames of excitation signals with a reduced number of gain scale factors employed in quantization steps to reduce the number of searches; and an algebraic code-excited linear prediction (ACELP) block configured to transmit at 5.3 Kbps and configured to perform a first correlation threshold test for entry into an embedded signal processing loop and a second correlation threshold test for entry into a previous signal processing loop in which the embedded signal processing loop is embedded to reduce the number of times the previous signal processing loop and the embedded processing loop are entered, the second correlation threshold test configured to apply for entry into a third signal processing loop and a fourth signal processing loop, the second threshold test limited to a predetermined number of times the third and fourth signal processing loops may be entered.

23. A dual rate speech encoding system for multimedia communications, comprising:

a multi-phase maximum likelihood quantization (MP-MLQ) block for fixed code book excitation at a first transmission rate, the MP-MLQ block configured to search sub frames of excitation signals with gain scale factors employed in quantization steps to reduce the number of searches, the MP-MLQ block configured to reduce the number of gain scale factors searched from four to two when a pitch lag of the sub frame is less than 58, and when the pitch lag of the sub frame is equal to or greater than 58, the number of gain scale factors searched is reduced from four to three, wherein the predetermined parameter is 58; and an algebraic code-excited linear prediction (ACELP) block configured to transmit at a second transmission rate, the ACELD and configured to perform a first correlation threshold test for entry into an embedded signal processing loop and a second correlation threshold test for entry into a previous signal processing loop in which the embedded signal processing loop is embedded to reduce the number of times the previous signal processing loop and the embedded processing loop are entered, the second correlation threshold test configured to apply for entry into a third signal processing loop and a fourth signal processing loop, the second threshold test limited to a predetermined number of times the third and fourth signal processing loops may be entered.

* * * * *